US008047860B2

(12) United States Patent
Gladd et al.

(10) Patent No.: US 8,047,860 B2
(45) Date of Patent: Nov. 1, 2011

(54) CONNECTOR ENGAGE MECHANISM

(75) Inventors: Joseph Howard Gladd, Cortland, OH (US); Joseph Matthew Senk, Cortland, OH (US)

(73) Assignee: Delphi Technologies, Inc., Troy, MI (US)

( * ) Notice: Subject to any disclaimer, the term of this patent is extended or adjusted under 35 U.S.C. 154(b) by 735 days.

(21) Appl. No.: 12/228,447

(22) Filed: Aug. 13, 2008

(65) Prior Publication Data

US 2010/0041510 A1 Feb. 18, 2010

(51) Int. Cl.
*H01R 13/62* (2006.01)

(52) U.S. Cl. ..... 439/152

(58) Field of Classification Search ..... 74/89.16; 439/76.2, 152, 157
See application file for complete search history.

(56) References Cited

U.S. PATENT DOCUMENTS

| | | | | |
|---|---|---|---|---|
| 5,023,752 | A | 6/1991 | Detter et al. | |
| 6,361,336 | B1 * | 3/2002 | Zhao et al. | 439/157 |
| 6,926,541 | B2 * | 8/2005 | Takeuchi et al. | 439/76.2 |
| 6,952,349 | B2 * | 10/2005 | Gough et al. | 361/741 |
| 7,066,763 | B1 * | 6/2006 | Corwin et al. | 439/372 |
| 7,094,081 | B1 | 8/2006 | Senk et al. | |
| 7,125,263 | B2 * | 10/2006 | Rho | 439/76.2 |
| 2010/0038133 | A1 * | 2/2010 | Senk et al. | 174/72 B |

* cited by examiner

*Primary Examiner* — Dirk Wright
(74) *Attorney, Agent, or Firm* — Thomas N. Twomey

(57) ABSTRACT

An electrical assembly comprises an upper electrical center assembly and a lower mounting bracket lift assembly that is adapted for being secured to a support panel such as a support panel in an automobile. After the lower mounting bracket lift assembly is secured to the support panel, the upper electrical center assembly is attached to the lower mounting bracket lift assembly. The lower mounting bracket lift assembly is then operated to plug wiring harness end connectors in the lower mounting bracket lift assembly into lower sockets of the upper electrical center assembly.

20 Claims, 6 Drawing Sheets

CONNECTOR ENGAGE MECHANISM

BACKGROUND OF THE INVENTION

This invention relates to electrical connectors and more particularly to a mechanism for engaging electrical connectors.

Electrical centers for automobiles generally include a large number of electric terminals that must be plugged into a corresponding number of mating electric terminals in one or more electrical connectors usually at the end of one or more wiring harnesses. The engagement force, that is, the force required to engage the electrical connector or connectors to the electrical center is relatively high due to the large number of terminals. This relatively high engagement force requires mechanical assistance.

There are two generally known solutions to the assembly problem caused by high engagement forces. One type uses a nut and bolt arrangement to draw the electrical connector into engagement with the electrical center. An example of this first mechanical solution is disclosed in the U.S. Pat. No. 5,023,752 granted to Gary C. Detter et al. Jun. 11, 1991 for an electrical power distribution center. Systems such as that disclosed in the Detter et al. patent have several drawbacks. They take up precious space on the printed circuit board, require assembly tools in the assembly plant where the electrical connectors are mated, and assembly time to mate each electrical connection which can become particularly burdensome if multiple connections are involved such as shown in the Detter et al. patent.

The second generally known solution to the assembly problem uses a cam lever and cam follower draw the electrical center and the electrical connector together. An example of this second mechanical system is disclosed in the U.S. Pat. No. 7,094,081 granted to Joseph M. Senk et al Aug. 22, 2006 for an electrical connector assembly. These systems also have their drawbacks. Extra components such as cam levers and followers are required which increases piece and tooling cost. Moreover, additional space is required to operate the cam lever or levers.

SUMMARY OF THE INVENTION

This invention provides a mounting bracket lift assembly for engaging electrical connectors, such as wiring harness end connectors to an electrical center, that does not take up space on the printed circuit board of the electrical center nor require the additional space of a cam lever system.

The mounting bracket lift assembly has a bracket tower, and a lift mechanism that is disposed in the bracket tower. The lift mechanism includes a lift plate that moves vertically in the bracket tower to make an electrical connection.

DETAILED DESCRIPTION OF PREFERRED EMBODIMENT

Figure 1:
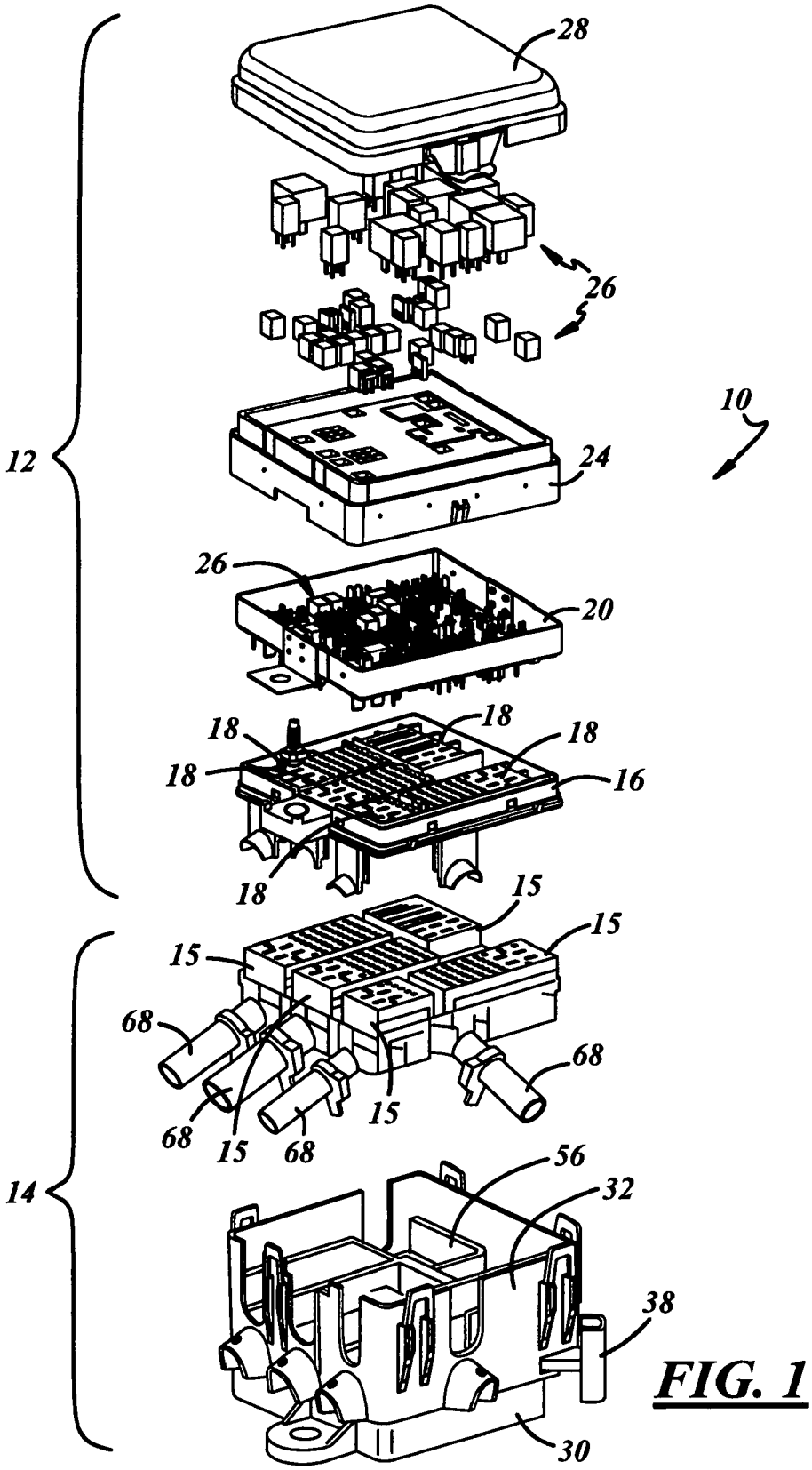
FIG. 1 is a an exploded perspective view of an electrical assembly that includes a connector engage mechanism of the invention.

Referring now to the drawings, FIG. 1 discloses an electrical assembly 10 comprising an upper electrical center assembly indicated generally at 12 and a lower mounting bracket lift assembly 14 that holds a plurality of wiring harness end connectors or other electrical connectors 15.

The lower mounting bracket lift assembly 14 is adapted for being secured to a support panel (not shown) such as a support panel in an automobile. After the lower mounting bracket lift assembly 14 is secured to the support panel, electrical connectors 15 are placed in their respective positions in the lower bracket lift assembly 14. The upper electrical center assembly 12 is then attached to the lower mounting bracket lift assembly 14. The lower mounting bracket lift assembly 14 is then operated to plug the electrical connectors 15 into lower sockets of the upper electrical center assembly 12 as explained below.

The upper electrical center assembly 12 comprises a lower molded plastic connector housing 16 that has a bottom portion that is configured with a plurality of sockets 18, and a circuit board assembly 20 that carries a plurality of electric terminals 22 that extend through a printed circuit board. The electric terminals are electrically connected by electrical traces of the circuit board in a desired way for incorporating electric components above the circuit board into various electrical circuits via the electrical connectors 15 in the lower mounting bracket lift assembly 14. More specifically electric components located above the circuit board 20 are plugged into upper portions of the electric terminals and the lower portions of these electric terminals in turn are plugged into electrical connectors 15 located below the circuit board 20 that are lifted into the sockets 18 as explained below.

The upper electrical connector assembly 12 further comprises an upper plastic connector housing 24 that is attached to the lower plastic connector housing 16 with the circuit board disposed in an internal cavity formed by housings 16 and 24 and the lower portions of the electric terminals projecting into the sockets 18.

After the upper plastic housing 24 is attached to the lower plastic housing 16, electric components 26, such as relays and fuses are plugged into the upper plastic housing 24. A cover 28 is then attached to the upper plastic housing 24 to protect the electric components 26. This completes the upper electrical center assembly 12. Electrical center 12 is described in detail in a companion patent application Ser. No. 12/228,446, filed Aug. 13, 2008 concurrently herewith which is hereby incorporated by reference.

As indicated above, the electrical components 26, such as relays and fuses are incorporated into various electric circuits via wiring harnesses that have electrical connectors that are plugged into the sockets 18. Each year automobiles become more complex requiring increasing numbers of electrical connections at an electrical center. The lower mounting bracket lift assembly 14 provides an apparatus for making several electrical connections with little effort.

The lower mounting bracket assembly 14 may be used with any electrical assembly even though it is illustrated and described in connection with the particular electrical center assembly 12.

The lower mounting bracket lift assembly 14 comprises a mounting bracket base 30 and a bracket tower 32. A ring gear 34 is rotationally mounted in the bottom of the bracket tower 32. The ring gear 34 has an integral operating lever 36 that protrudes through a slot of the bracket tower 32 to provide an external operating handle 38 at the end of the operating lever 36 that is outside the bracket tower 32.

The bracket tower 32 has a center low profile boss (not shown) and four posts in a quadrilateral arrangement, one of which is shown as post 40, for locating a gear lift mechanism 42 that may be formed as a sub-assembly. The gear lift mechanism 42, FIGS. 3 and 4, includes a lift plate 44 that has four depending circular sleeves 46 in a quadrilateral arrangement. Each circular sleeve 46 is internally threaded and receives an upper screw member 48 of a composite rotor 50 that has a lower planetary gear 52. The four lower planetary gears 52 mesh with a sun gear 54 that is rotatably attached to the lift plate 44 at the center of the quadrilateral arrangement of planetary gears 52.

The gear lift mechanism 42 is disposed in the bracket tower 32 so that the sun gear 54 fits on the center low profile boss and the four planetary gears 52 rotate on the four quadriterally arranged posts 40. The four planetary gears mesh 52 with the ring gear 34 as well as the sun gear 54. The low profile boss is shaped so that the sun gear 54 rotates in the bracket tower 32. Thus rotation of the ring gear 34 by the operating lever 36 and handle 38 produces simultaneous rotation of the four planetary gears 52 about fixed centers established by posts 40 and a counter rotation of the sun gear 54.

The lift plate 44 has a non-rotary telescopic fit in the bracket tower 32 so that lift plate 44 rises in the bracket tower 32 responsive to rotation of the planetary gears 52 and the attached screw members 48 in one direction and lift plate 44 lowers in the bracket tower 32 in response to rotation of the planetary gears 52 and screw members 48 in an opposite direction.

A connector holder retainer 56 is fastened to the top of the lift plate 44 and moves up and down with the lift plate 44. The connector holder retainer 56 may have a plurality of compartments 58 that have open ends 60 that are aligned with ports 62 in the outer wall of the bracket tower 32 to accommodate electrical connectors such as the end connectors 15 of wiring harnesses. The plurality of compartments 58 receive respective connector retainers 64 that are inserted into the compartments 58. The connector retainers 64 hold the end connectors 15 of various wiring harnesses 68 that extend through the ports 62 and open ends 60 of the compartments 58.

The bracket tower 32 includes a plurality of flexible latch arms 70 for retaining the upper electrical connector assembly 12 and preferably also includes a flex lock 72 to retain the operating lever 36 and handle 38 in an engaged position as explained below.

Figure 2:
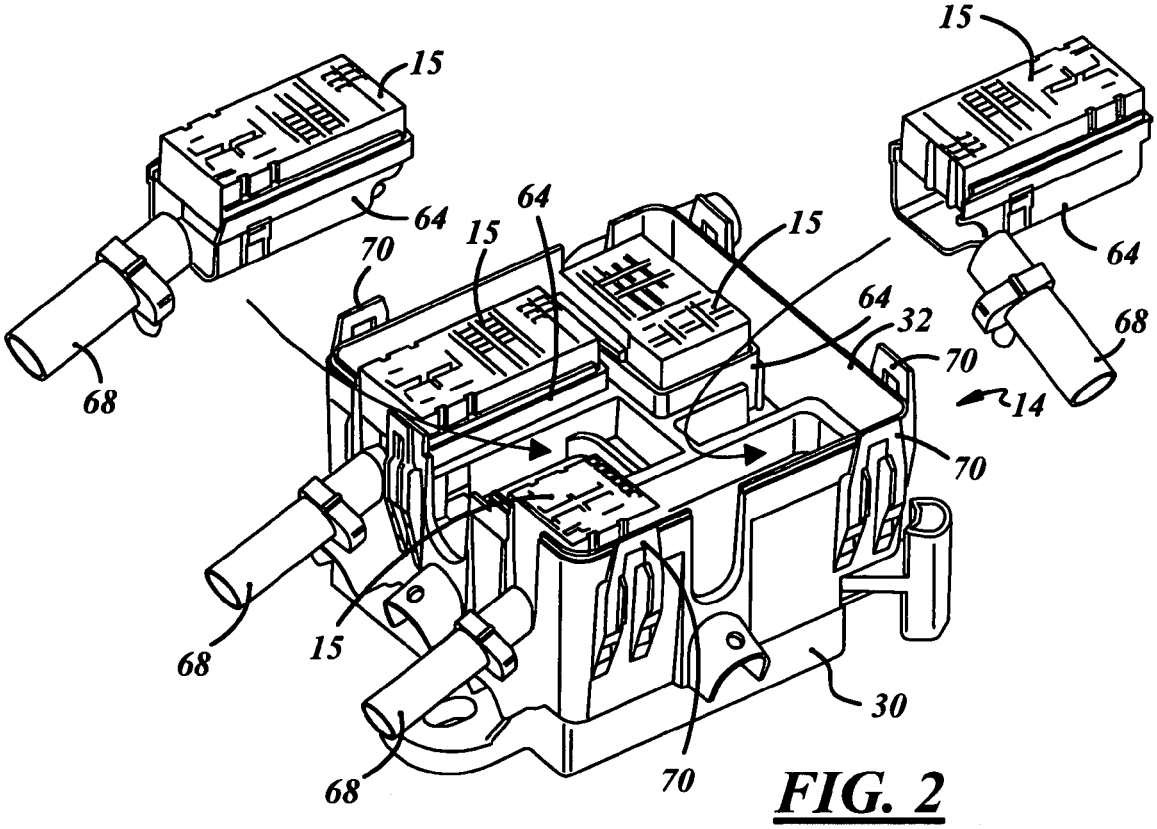
FIG. 2 is an exploded perspective view of two components of the electrical assembly of FIG. 1.
Figure 7:
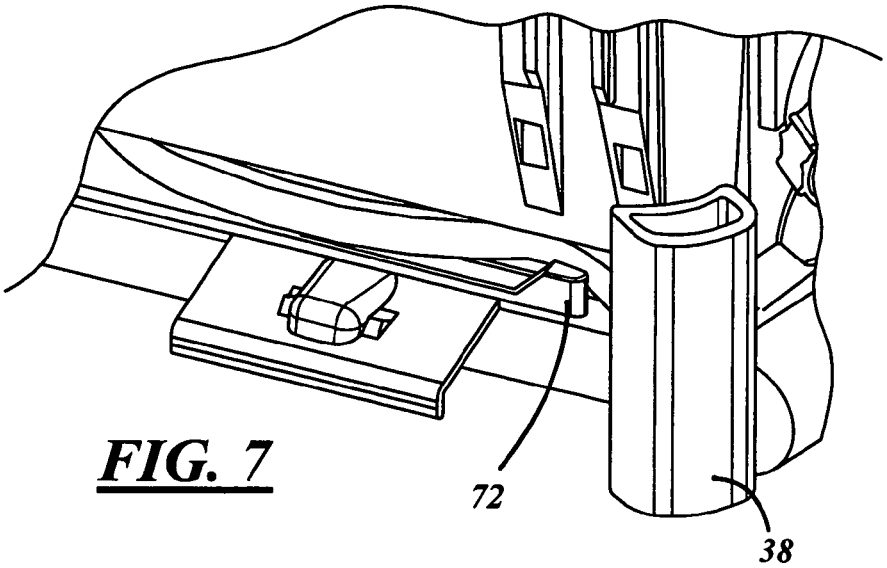
FIG. 7 is an enlargement of a portion of FIG. 6.
Figure 4:
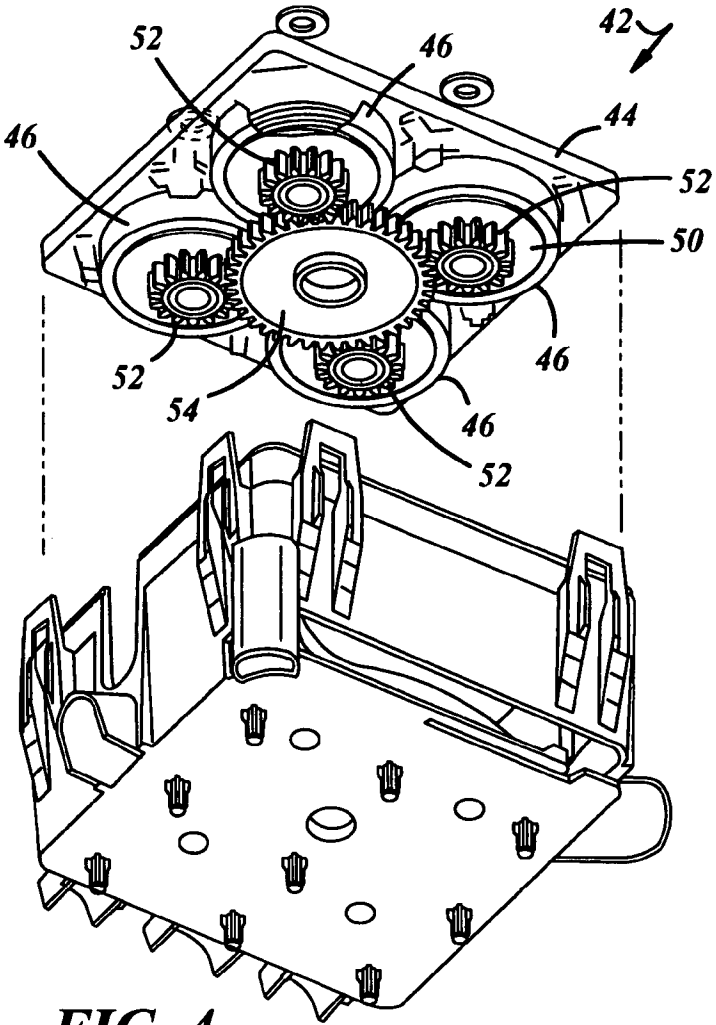
FIGS. 3, 4 and 5 are exploded perspective views of the connector engage mechanism at various stages of assembly.
Figure 3:
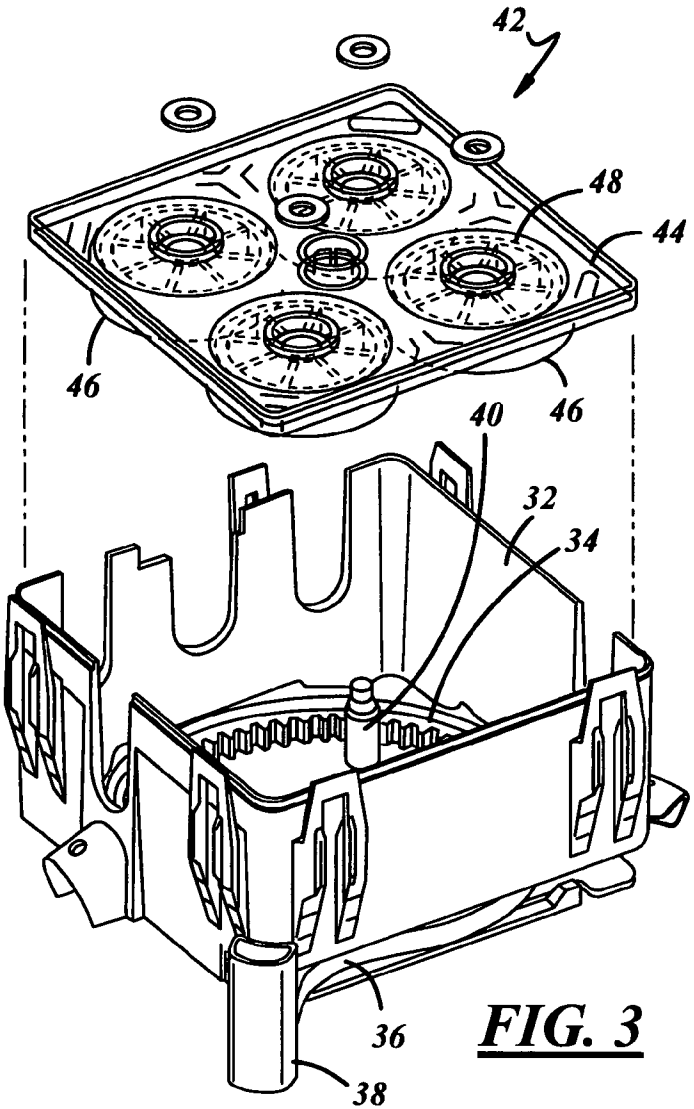
Figure 5:
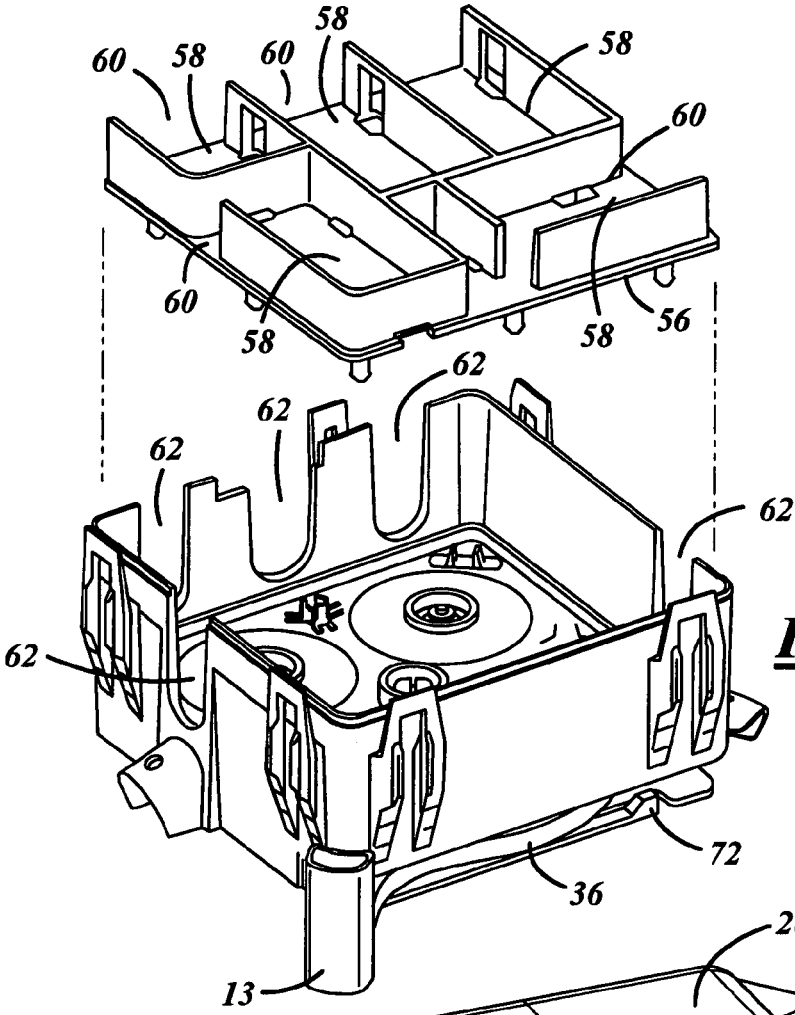

The lower mounting bracket assembly 14 is assembled in the following manner. The ring gear 34 is assembled to the bracket tower 32 and positioned so that the operating lever 36 and handle 38 are adjacent an end of the slot through the wall of the bracket tower 32. The gear lift mechanism 42 is fabricated as a sub-assembly and inserted into the bracket tower 32 so that the sun gear 54 rotates on the center low profile boss and the planetary gears 52 rotate on the four posts 40 and mesh with the ring gear 34; and the lift plate 44 is in a low disengaged position as shown in FIGS. 3, 4 and 5. The connector holder retainer 56 is then inserted into the bracket tower 32 and fastened to the top of the lift plate 44 of the gear lift sub-assembly 42 as shown in FIGS. 2 and 5. The bracket tower 32 is then attached to the bracket base 30.

The connector retainers 64 which are attached to the end connectors 15 of the wiring harnesses 68 are then inserted into the compartments 58 of the connector holder retainer 56 with the wiring harnesses 68 extending through the ports 62 and open ends 60 of the compartments 58 as shown in FIG. 2.

Figure 6:
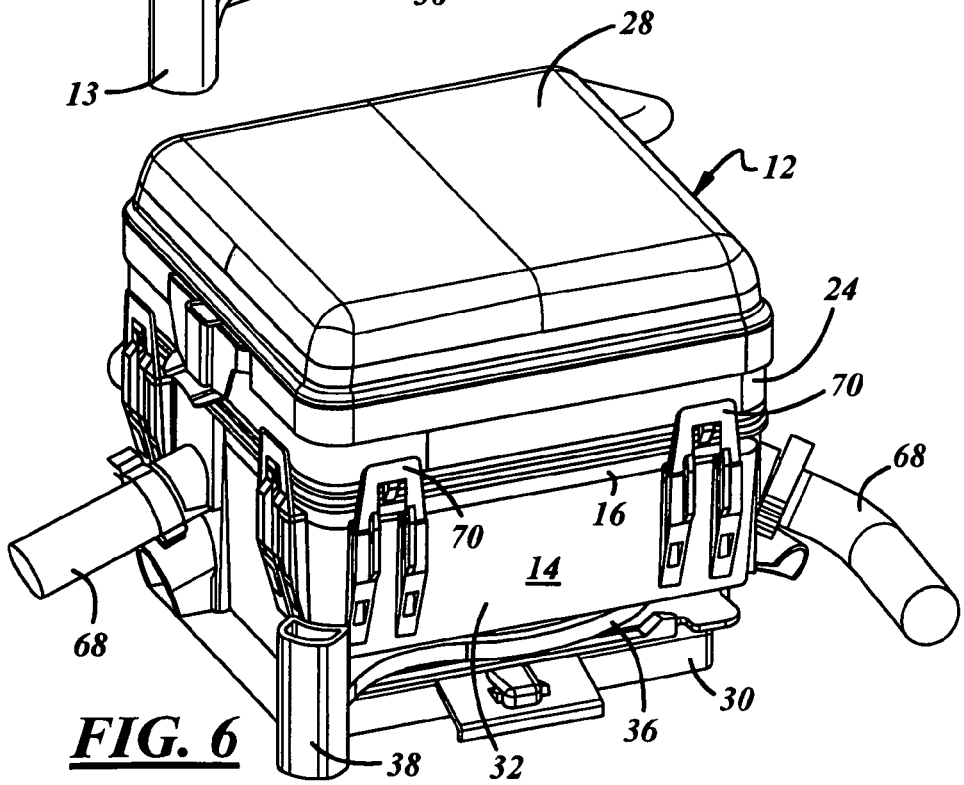
FIG. 6 is a perspective view of the electrical assembly shown in FIG. 1.
Figure 8:
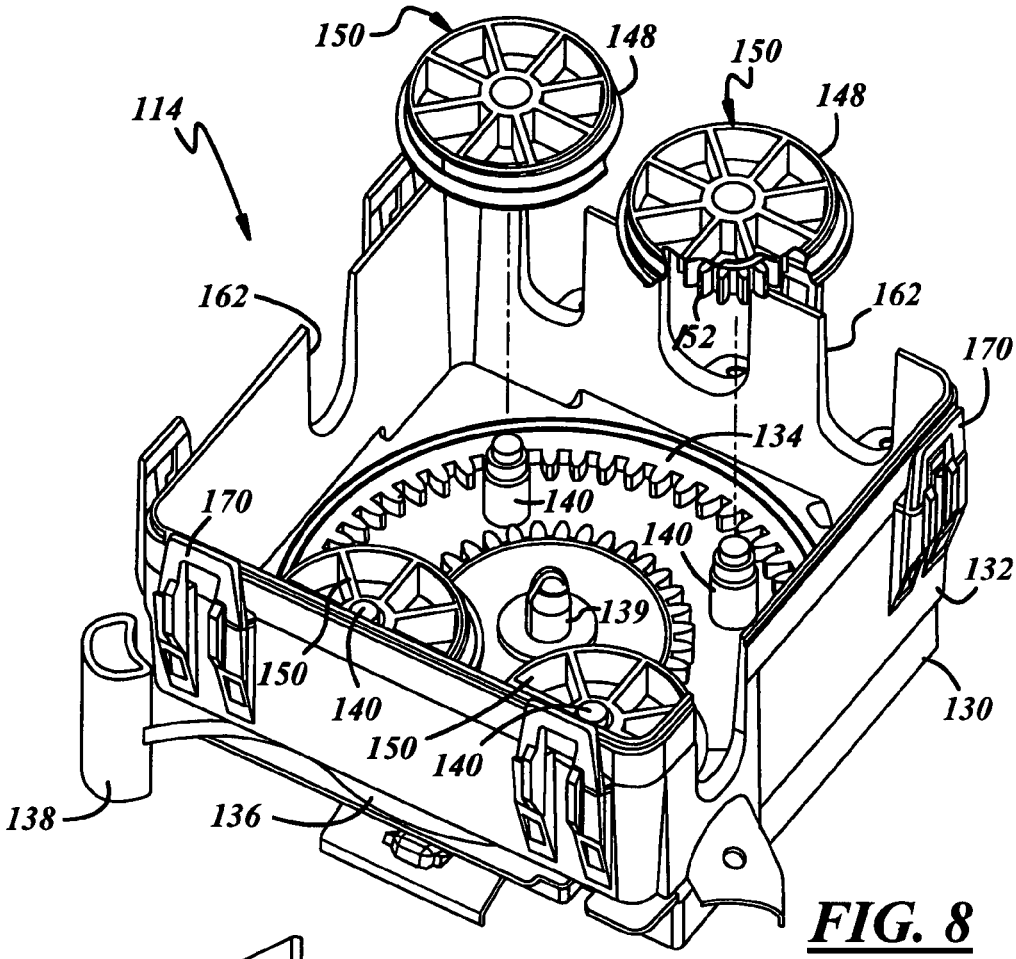
FIGS. 8, 9, 10, and 11 are exploded perspective views of the another embodiment of a lower mounting bracket lift assembly at various stages of assembly.

The upper electrical connector assembly 12 is then attached to the lower mounting bracket assembly 14 and retained by the flexible latch arms 70 as shown in FIG. 6. The gear lift mechanism 42 inside the bracket tower 32 is then operated by moving the external handle 38 to rotate the ring gear 34 about 90 degrees. More specifically, handle 38 is moved counterclockwise from a disengaged position adjacent one end of the slot through which the lever 36 protrudes to an engaged position adjacent an opposite end of the slot through which lever 36 protrudes. In other words, the handle 38 is moved from one corner of the square bracket tower 32 to the next corner. Handle 38 thus rotates the internal ring gear 34 which in turn rotates the four planetary gears 52 and the upper screw members 48 attached to them which in turn raises the lift plate 44 which in turn pushes the end connectors 15 into engagement with the terminals of the upper electrical center assembly. As indicated above, the handle 38 is preferably locked in place by a flex lock 72 when the lift plate plate 44 is raised to the engaged position.

Referring now to FIGS. 8, 9, 10 and 11, exploded perspective views of another embodiment of a lower mounting bracket lift assembly 114 is illustrated at various stages of assembly.

The lower mounting bracket lift assembly 114 comprises a mounting bracket base 130 and a bracket tower 132. A ring gear 134 is rotationally mounted in the bottom of the bracket tower 132. The ring gear 134 has an integral operating lever 136 that protrudes through a slot of the bracket tower 132 to provide an external operating handle 138 at the end of the operating lever 136 that is outside the bracket tower 132.

The bracket tower 132 has a center boss 139 and four posts 140 in a quadrilateral arrangement for locating a gear lift mechanism 142 that includes a lift plate 144 that has four depending circular sleeves 146 in a quadrilateral arrangement. Each circular sleeve 146 is internally threaded and receives an upper screw member 148 of a composite rotor 150 that has a lower planetary gear 152. The four lower planetary gears 152 mesh with a sun gear 154. The sun gear 154 is rotatably attached to the bracket tower 132 by the center boss 139 and the four lower planetary gears 152 are rotatably attached to the quadrilateral arrangement of posts 140 so that the lower planetary gears 152 mesh with the sun gear 154 as well as the ring gear 134. Thus rotation of the ring gear 134 by the operating lever 136 and handle 138 produces simultaneous rotation of the four planetary gears 152 about fixed centers established by posts 140 and a counter rotation of the sun gear 154 about the fixed center established by boss 139.

The lift plate 144 has a non-rotary telescopic fit in the bracket tower 132 so that lift plate 144 rises in the bracket tower 132 responsive to rotation of the planetary gears 152 and the attached screw members 148 in one direction and lift plate 144 lowers in the bracket tower 132 in response to rotation of the planetary gears 152 and screw members 148 in an opposite direction.

A connector holder retainer 156 is fastened to the top of the lift plate 144 and moves up and down with the lift plate 144. The connector holder retainer 156 may have a plurality of compartments 158 that have open ends 160 that are aligned with ports 162 in the outer wall of the bracket tower 132 to accommodate electrical end connectors 15 of wiring harnesses 68. The plurality of compartments 158 receive respective connector retainers (such as connector retainers 64 shown in FIG. 2) that are inserted into the compartments 158. The connector retainers hold the electrical end connectors 15 of various wiring harnesses 68 that extend through the ports 162 and open ends 160 of the compartments 158.

The bracket tower 132 includes a plurality of flexible latch arms 170 for retaining the upper electrical center assembly 12 (FIG. 1) and preferably also includes a flex lock 72 to retain the operating lever 136 and handle 138 in an engaged position as explained below.

The lower mounting bracket assembly 114 is assembled in the following manner. The bracket tower 132 is assembled to the bracket base 130. The ring gear 134 is then assembled to the bracket tower 132 and positioned so that the operating lever 136 and handle 138 are adjacent an end of the slot through the wall of the bracket tower 132. The sun gear 154 is then assembled to the bracket tower 132 so that it rotates on the center 139. The four composite rotors 150 are assembled to the four posts 140 so that the planetary gears 152 rotate and mesh with the ring gear 134 and the sun gear 154. During assembly, the four composite rotors 150 are exactly aligned via molded in arrows or any other suitable means so that the upper screw members 148 are positioned for insertion into the internally threaded circular sleeves 146 of the lift plate 144.

Figure 9:
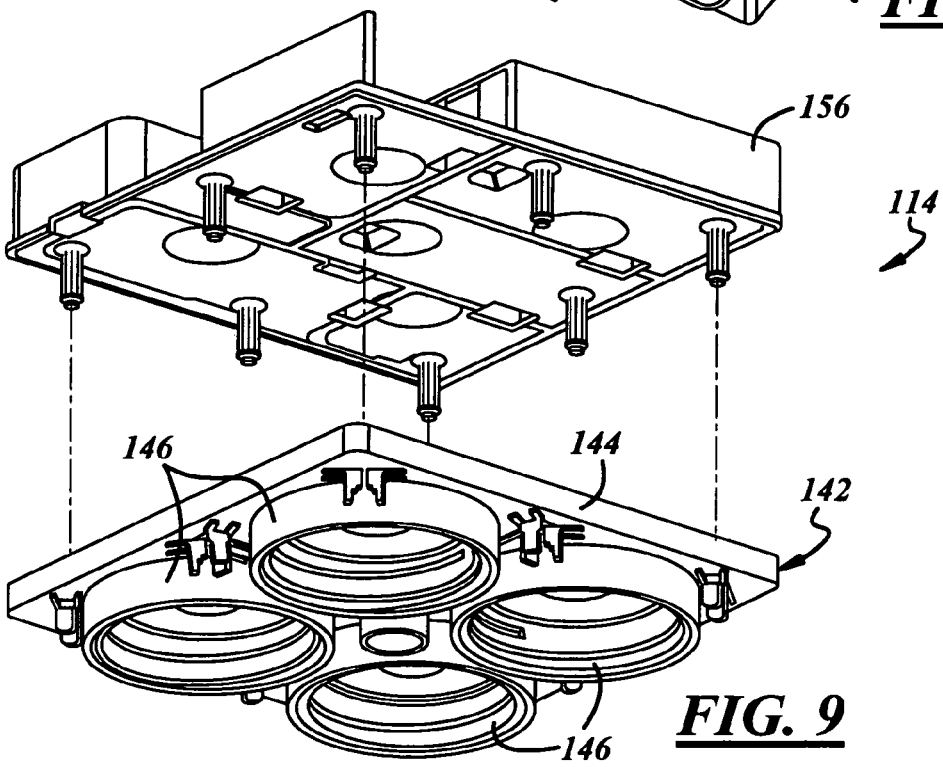
Figure 10:
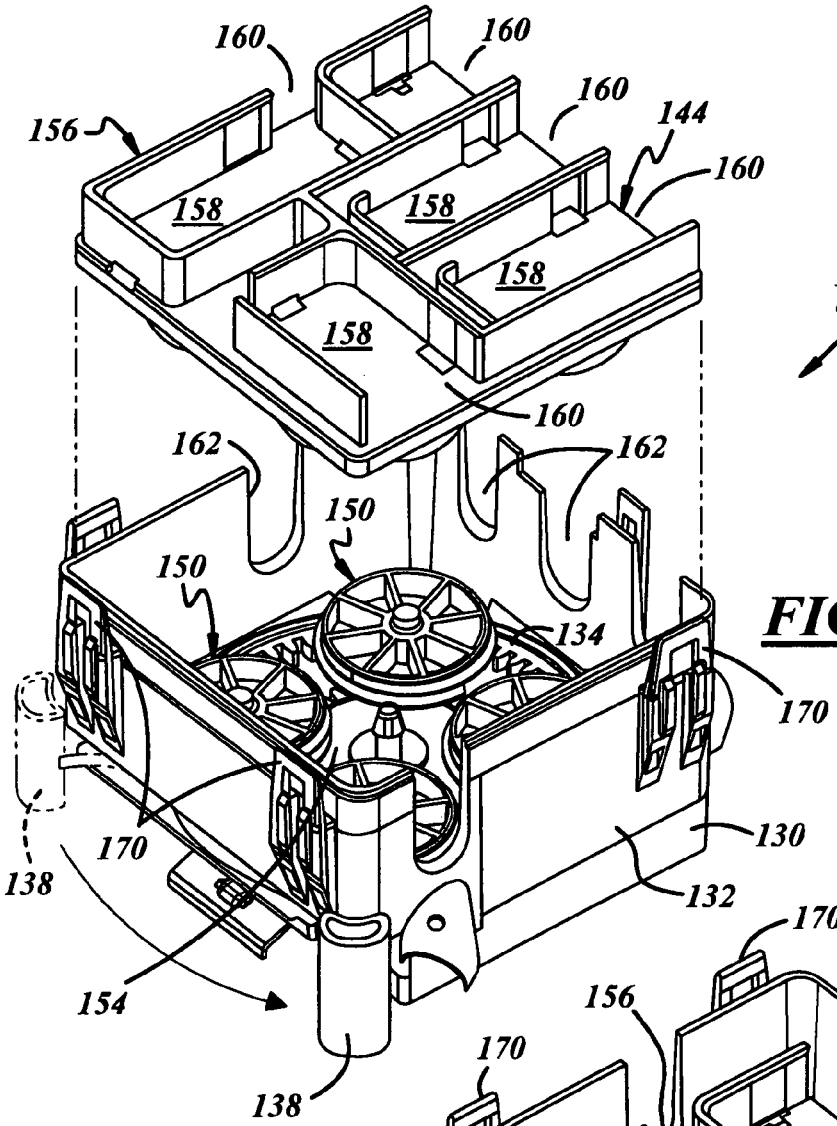
Figure 11:
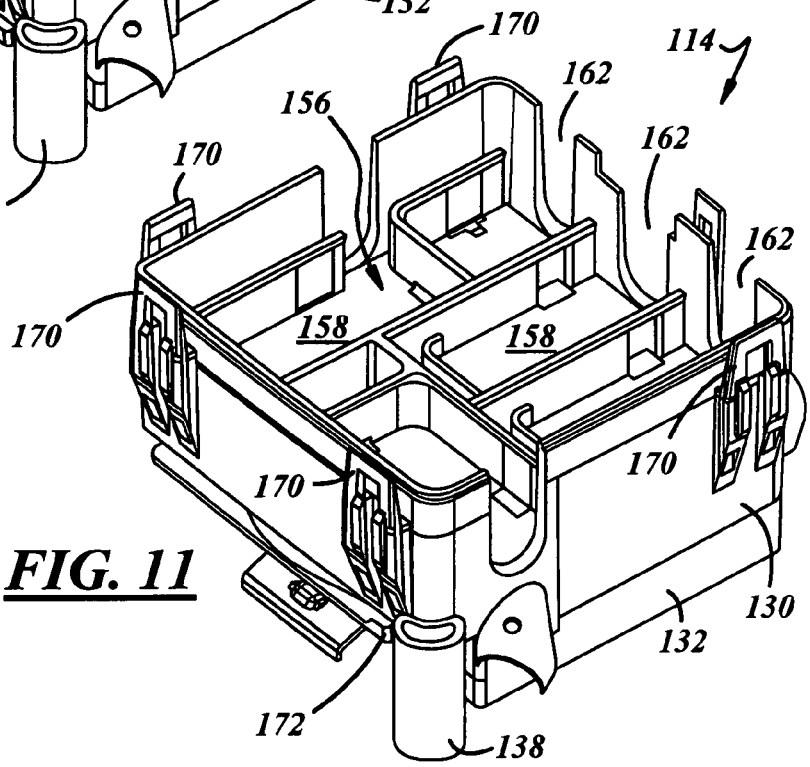

In the meantime, the connector holder 156 is assembled to the lift plate 144 by snap locks as best shown in FIG. 9. The connector holder retainer 156 and lift plate 144 are then inserted into the bracket tower 132 with the handle 138 in the engaged position shown in FIG. 10. The connector holder 156 and attached lift plate 144 are then pressed against the composite rotors 150. As the connector holder 156 and attached lift plate are pressed down, the upper screw members 148 are screwed into the sleeves 146 rotating planetary ears 152 whereby the ring gear 134 and handle 138 are rotated back to the disengaged position shown in phantom in FIG. 10.

The connector retainers, such as the connector retainers 64 (FIG. 2) which are attached to the end connectors 15 of the wiring harnesses 68 are then inserted into the compartments 158 of the connector holder retainer 156 with the wiring harnesses 68 extending through the ports 162 and open ends 160 of the compartments 158.

The upper electrical connector assembly 12 is then attached to the lower mounting bracket assembly 114 and retained by the flexible latch arms 170. The gear lift mechanism 142 inside the bracket tower 132 is then operated by moving the external handle 138 to rotate the ring gear 134 about 90 degrees. More specifically, handle 138 is moved from a disengaged position adjacent one end of the slot through which the lever 136 protrudes shown in phantom in FIG. 10 to an engaged position adjacent an opposite end of the slot through which lever 136 protrudes. In other words, the handle 138 is moved from one corner of the square bracket tower 132 to the next corner. Handle 138 thus rotates the internal ring gear 134 which in turn rotates the four planetary gears 152 and the upper screw members 148 attached to them simultaneously which in turn raises the lift plate 144 which in turn pushes the electrical end connectors 15 into engagement with the terminals of the upper electrical connector assembly 12. As indicated above, the handle 138 is preferably locked in place by a flex lock 172 when the lift plate 144 is raised.

It should be noted that in each of the two embodiments discussed above, the gear lift mechanisms 42 and 142 provide a double mechanical advantage. Rotation of the planetary gears 52 and 152 by the handles 38 and 138 via the ring gears 34 and 134 provides a first mechanical advantage while the concurrent rotation of the screw members 48 and 148 in the internally threaded sleeves 46 and 146 provides a second mechanical advantage.

While the forms of the invention herein disclosed constitute presently preferred embodiments, many others are possible. It is not intended herein to mention all the possible equivalent forms or ramifications of the invention. It is understood that the terms used herein are merely descriptive rather than limiting and that various changes may be made without departing from the spirit or scope of the invention.

We claim:

1. A mounting bracket lift assembly comprising:

a bracket tower, and a lift mechanism that is disposed in the bracket tower, the lift mechanism including a lift plate that is telescopically disposed in the bracket tower for vertical movement in the bracket tower.

2. The mounting bracket lift assembly of claim 1 wherein the lift mechanism comprises a plurality of internally threaded sleeves that are fixedly attached to the lift plate and a plurality of rotors having screw members that are engaged in the internally threaded sleeves respectively so that the lift plate is raised in the bracket tower when the plurality of rotors are rotated about respective fixed centers in one direction and lowered in the bracket tower when the plurality of rotors are rotated about the respective fixed axes in an opposite direction.

3. The mounting bracket lift assembly of claim 2 further comprising a plurality of planetary gears that rotate the plurality of rotors about the respective fixed centers and a driver gear that meshes with the planetary gears for rotating the planetary gears.

4. The mounting bracket lift assembly of claim 3 wherein the plurality of planetary gears are non-rotatably attached to the plurality of rotors respectively.

5. The mounting bracket lift assembly of claim 4 further comprising an operating lever that protrudes through a slot of the bracket tower and wherein the driver gear is a ring gear that is attached to the operating lever.

6. The mounting bracket lift assembly of claim 5 further comprising a sun gear that meshes with the plurality of planetary gears.

7. The mounting bracket lift assembly of claim 6 wherein the bracket tower has a center boss on which the sun gear rotates.

8. The mounting bracket lift assembly of claim 5 further comprising a connector holder retainer that is fastened to a top of the lift plate.

9. The mounting bracket lift assembly of claim 8 wherein the bracket tower has a plurality of ports.

10. The mounting bracket assembly of claim 9 further comprising a plurality of connector retainers disposed in compartments of the connector holder retainer, and a plurality of end connectors disposed in the plurality of connector retainers respectively, the plurality of end connectors being attached to wiring harnesses that extend through the plurality of ports respectively.

11. The mounting bracket assembly of claim 1 wherein the lift mechanism is inserted into the bracket tower as a subassembly.

12. The mounting bracket assembly of claim 1 wherein the lift mechanism is assembled in the bracket tower.

13. A mounting bracket lift assembly comprising:

a bracket tower, and a lift mechanism including a lift plate that raises and lowers in the bracket tower, the lift plate having a plurality of internally threaded sleeves, and the lift mechanism including a planetary gear set having a ring gear rotatably disposed in the bracket tower and a plurality of planetary gears that are driven by the ring gear to drive screw members disposed in the internally threaded sleeves.

14. The mounting bracket lift assembly of claim 13 wherein the plurality of planetary gears are non-rotatably attached to the plurality of rotors respectively to form a plurality of composite rotors.

15. The mounting bracket lift assembly of claim 14 further comprising an operating lever that protrudes through a slot of the bracket tower and attached to the ring gear is a ring gear that is attached to the operating lever.

16. The mounting bracket lift assembly of claim 15 further comprising a sun gear that meshes with the plurality of planetary gears.

17. The mounting bracket lift assembly of claim 16 further comprising a connector holder retainer that is fastened to a top of the lift plate.

18. The mounting bracket lift assembly of claim 17 wherein the bracket tower has a plurality of ports and wherein the mounting bracket assembly further comprises a plurality of connector retainers disposed in compartments of the connector holder retainer, and a plurality of end connectors disposed in the plurality of connector retainers respectively, the plurality of end connectors being attached to wiring harnesses that extend through the plurality of ports respectively.

19. The mounting bracket assembly of claim 18 wherein the lift mechanism is inserted into the bracket tower as a sub-assembly.

20. The mounting bracket assembly of claim 18 wherein the lift mechanism is assembled in the bracket tower.

* * * * *